US006093070A

United States Patent [19]

Mannes

[11] Patent Number: 6,093,070

[45] Date of Patent: Jul. 25, 2000

[54] MAN OVERBOARD DEVICE

[76] Inventor: Harald Mannes, Smedaveien 6, N-4280 Skudeneshavn, Norway

[21] Appl. No.: 09/269,844

[22] PCT Filed: Sep. 24, 1997

[86] PCT No.: PCT/NO97/00260

§ 371 Date: Jun. 4, 1999

§ 102(e) Date: Jun. 4, 1999

[87] PCT Pub. No.: WO98/14364

PCT Pub. Date: Apr. 9, 1998

[30] Foreign Application Priority Data

Oct. 1, 1996 [NO] Norway ..... 964152
Jan. 28, 1997 [NO] Norway ..... 970353

[51] Int. Cl.[7] ..... B63C 9/00
[52] U.S. Cl. ..... 441/80; 441/84
[58] Field of Search ..... 441/80, 84

[56] References Cited

U.S. PATENT DOCUMENTS 1,282,323 10/1918 Trinkle .
2,700,781 2/1955 Smith .
4,678,446 7/1987 Dahan .

FOREIGN PATENT DOCUMENTS 156860 8/1987 Norway .
171896 2/1993 Norway .
2162469A 2/1986 United Kingdom .
2270881A 3/1994 United Kingdom .
WO 88/03495 5/1988 WIPO .

*Primary Examiner*—Jesus D. Sotelo
*Attorney, Agent, or Firm*—Timothy J. Martin; Michael R. Henson; Mark H. Weygandt

[57] ABSTRACT

A rescue device, and man overboard device for use therewith, is adapted for use with a ship to rescue individuals floating at sea and may comprise a lifting crane, and a plurality of fasteners, rope-like elements and connectors. The lifting crane includes a crane beam having a proximal end mounted for pivotal movement about a vertical crane axis and extends laterally from the proximal end to terminate at a free end. The fasteners are attached to the crane beam and may be equidistantly distributed therealong. Each of the rope-like elements has a first end portion adapted for attachment to a respective one of the fasteners and extends therefrom to terminate at a free distal end. Each connector, such as a hoisting strap, is operative to connect to the free distal end of an associated rope-like element and securely engage an individual in need of rescue so that the individual can be lifted out of the sea by the lifting crane. Shackles are disposed on the rope-like elements to connect them to wench lines, and a laterally extending connecting line joins at least some of the rope-like rescue elements.

30 Claims, 4 Drawing Sheets

MAN OVERBOARD DEVICE

FIELD OF INVENTION

The present invention relates to a man overboard device creating a possibility of rescue for people fallen into the sea and in need for rapid supply of rescue equipment. The man overboard device is structurally and functionally simple. The present invention also relates to a rescue device incorporating such a man overboard device. The rescue device comprises a raisable/lowerable lifting crane pivotal about a vertical axis and mounted on a ship, such as a supply boat. Attached to the lifting crane's beam is the man overboard device which has rescue means for at least one individual. It is preferred that a rescue net be mounted on at least one side of the boat to which a man overboard fixed to said rescue means possibly may be transferred, before the person in question is brought to land on the deck of the boat.

A person hanging from the rescue means of the man overboard device may also be lifted on board the boat.

BACKGROUND OF THE INVENTION

In heavy sea, it might be dangerous with relatively large ships, e.g. supply boats, to go too close to men overboard drifting in the sea, because they may be pressed down into the sea by the ship side.

Most standby ships or man overboard boats operating in the areas around offshore installations such as platforms, drilling ships, etc., are equipped with the above-mentioned raisable and lowerable as well as pivotable lifting crane. In order to avoid the foregoing problem, it is known to attach a basket at the outer free end of the crane beam, so that this basket-shaped rescue means upon the occurrence of a crane beam position corresponding to a more or less swung-out beam, will be situated at a certain distance from the ship side, dependent on the angle which the crane beam forms in relation to the longitudinal direction of the ship side. If the crane beam takes a position approximately at right angles on the ship side, the rescue basket will be located at a maximum distance therefrom.

Especially in bad weather, it is difficult to operate the basket such that the man overboard in the sea gets hold of it. Moreover, it may cause problems to get into such a rescue basket, and its suspension at the outer free end of the crane beam causes restrictions in respect of its extent and, thus, capability of accommodation. In practice, one will only be capable of constructing such a rescue basket for the accommodation of only a very few people at a time, while the need for rapid rescue often will concern a substantially larger number, particularly at low sea water temperatures.

SUMMARY OF THE INVENTION

Therefore, the object of the present invention has been to provide a simple man overboard device of the kind which exhibits a large capacity, wherein men overboard floating in the sea are offered downwardly suspending rope-like rescue means having additional equipment simple in structural shape and design, and which are easy to use for men overboard drifting in the sea.

According to the invention, this object is realized by means of a man overboard device shaped, designed and adapted in accordance with the appended claims.

The raisable and lowerable as well as pivotal lifting crane's beam, which may project 20 meters horizontally out from the ship side, is provided with fasteners for ropes, lines or similar elongated, flexible elements, distributed, preferably equidistantly, along the longitudinal extent of the beam. Said ropes, lines, etc. may have an individual length of 10–40 meters, and the space between adjacent fasteners on the crane beam may e.g. constitute one meter.

Men overboard drifting along in the sea, will often float relatively gathered along a row due to wind and stream conditions. In a condition of readiness, the rescue means in the form of ropes, lines or the like may be kept accommodated in a storage case on deck. Adjacent the outer ends, opposite to the end to be connected to one of the fasteners of the crane beam, there may be a shackle or a similar means for a spring or snap hook or a similar closable hook. Hoisting straps/braces may also be located closer to the outer ends.

When searching for men overboard, the rescue means in the form of said ropes are immediately connected to the fasteners of the crane beamTherafter, the lifting crane is operated such that it, possibly, is raised prior to the crane beam being swung outwards from the side of the ship. Then, the lifting crane is lowered somewhat. The ship is operated such that the crane beam and the ropes suspended therefrom, which are submerged partly into the uppermost layer of the sea, "sweep" the area of the sea in which men overboard are supposed to be. The ship is operated at such a low speed which is compatible with justifiable steering and maneuvering conditions.

During this "sweep" across the field of the sea wherein the men overboard are assumed to be situated, they would have a relatively good possibility of fetching a grip of the downwardly suspended rescue lines, as compared with the known rescue basket, which only would be in a position to sweep a substantially narrower sea field than the row of rescue lines. The man overboard device according to the invention is thus capable of sweeping a field in the sea surface having a width corresponding to the distance between the outermost and innermost rescue line, e.g. a width of about 15 meters.

When one or more men overboard have got hold of one rescue line each and made themselves temporarily connected to a shackle or a similar attachment means, the person(s) concerned pull(s) the immediately adjacent hoisting straps/braces or the like, which may have the form of a ring of soft, flexible band which is placed beneath the arms. The person(s) in question will, thereafter, be well secured. At low sea temperatures and, thus, narrow time limits, the rescue work may, possibly, be assisted by helicopter which may hoist the man overboard up through the hoisting straps.

If several persons each have fastened themselves to the hoisting straps of the rescue line, the crane beam is rotated about the vertical rotational axis of the lifting crane until it approaches the ship side, where said persons have the opportunity of using the downwardly suspended rope net in a manner known per se. Also, it is possible to hoist injured, possibly heavy persons directly on board the ship's deck by means of the lifting crane.

It may be an advantage to connect the separate rescue lines mutually at a relatively short distance from their outer ends by means of a lateral line or the like, in order to keep the rescue lines approximately equally spaced from each other at the ends adjacent the hoisting straps and, also, in order to prevent the separate rescue lines from becoming entangled.

In association with said lateral connecting line, a winch line from a first winch, preferably carried by the crane beam, may be fastened at the free end thereof to the outer rescue element (situated furthest away from the boat), while a second winch line from a second winch which, likewise, preferably, is attached to the crane beam, is fastened to the inner rescue element (situated nearest to the boat) adjacent the outer end thereof. These winch lines, possibly by means of assigned guide/control means, are allotted a course in a downwardly suspended position substantially parallel to the longitudinal direction of the rescue elements.

The outer end of each winch line may be attached to the rescue element belonging thereto through the shackle of the latter, so that already existing fasteners are utilized for the attachment.

As the two winch lines are wound entirely on their respective winches, the men overboard will be hoisted up from the sea, to be subsequently swung in onto the boat deck by means of the crane beam. However, it may be that the lateral connecting line and rescue line portions connected thereto form a too large, downwardly suspended arch.

In order to remedy this disadvantage of the last discussed embodiment of the invention, the man overboard device may further comprise at least a third winch line located between the two first-mentioned winch lines, and assigned a (third) winch of its own. This third winch may advantageously be carried at the middle of the length of the crane beam, so that the winch line thereof, possibly through a guide/control means (groove wheel, caster, rowel), receives such a course that the free end thereof may be attached to the middle portion of the man overboard device, adjacent the outer edge thereof, e.g. through the lateral connecting line.

The invention is further explained in the following in association with a non-limiting exemplary embodiment and with reference to the accompanying drawings, where:

DETAILED DESCRIPTION OF THE EXEMPLARY EMBODIMENTS

Figure 1:
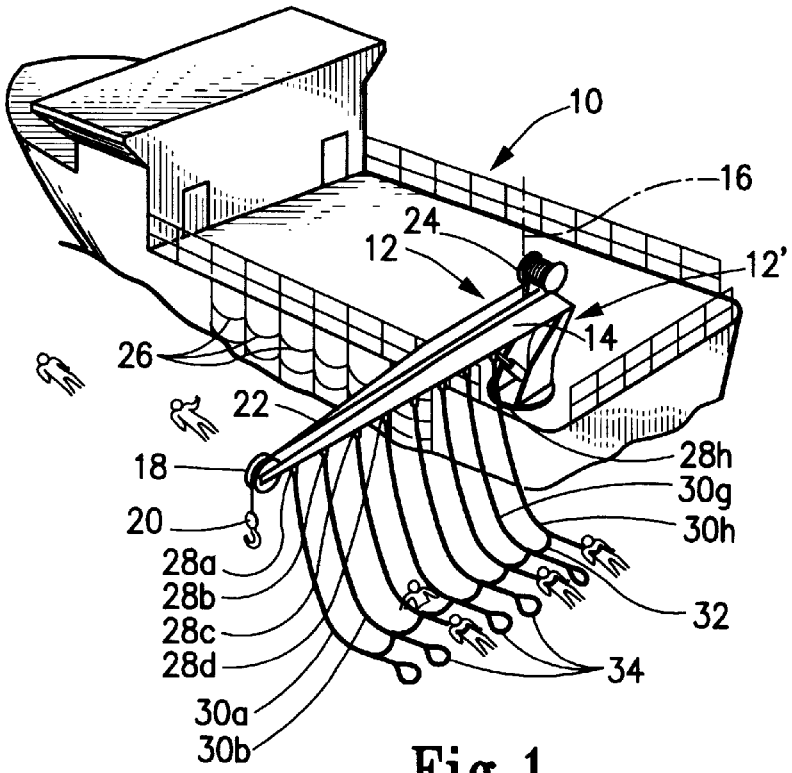
FIG. 1 shows a perspective situation view showing a man overboard boat in the form of a standby boat with a lifting crane installed on the deck thereof, and showing rescue lines suspended downwardly from the crane beam.

In FIG. 1, a man overboard boat 10, such as a standby boat, is shown. On the deck of the man overboard boat 10, as known per se, a lifting crane 12 has been installed, the crane beam 14 thereof being rotatable about a vertical axis 16, such that the crane beam 14 can be swung outwardly from the ship side, to form a desired angle therewith.

The lifting crane 12,14 exhibiting known features such as raisability and lowerability, has, at the outer, free beam end, a caster 18 for a standard lifting hook 20 fastened to a wire 22 passing to a winch 24 at the inner portion of the crane beam 14. Along the ship side on which the lifting crane borders, a rope net 26 has been tightened, as known per se, and to which men overboard can be transferred from the man overboard device on which they have caught a grip, in case they are in such a condition that it is assumed that they will manage to climb up to the deck of the man overboard boat 10 through the rope net 26.

In accordance with the present invention, a selected number of fasteners 28*a* through 28*h* are preferably spaced apart equidistantly along the longitudinal extent of the crane beam 14. To each of these fasteners 28*a*–28*h*, which may be in the form of hooks, rings, shackles or other simple fastening means, is attached one of a plurality of elongated an flexible rope-like element or rescue lines 30*a*–30*h*, each of which, according to the shown exemplary embodiment, has a first end portion attached individually in a suitable manner to a fastener 28*a*–28*h* belonging thereto. The fasteners 28*a*–28*h* may, alternatively, be attached to a rail, not shown, displaceable along a guidance fixed to the underside of the crane beam 14. Each line end may e.g. be equipped with a so called snap hook or another closable hook for immediate attachment to a respective fastener 28*a*–28*h*.

Preferably, the arrangement is such that the crane beam 14 at any time carries the fasteners 28*a*–28*h*, while the rescue lines 30*a*–30*h* are not mounted before a search for men overboard is to be effected. Alternatively, the rescue lines may be attached to a rail rapidly attachable to the crane beam 14.

Close to the free distal ends of the rescue lines 30*a*–30*h*, spaced therefrom a certain distance, is disposed lateral connecting line 32 connected to each of the rescue lines 30*a*–30*h* at the same or approximately the same distance as between the fasteners 28*a*–28*h* on the crane beam 14. This lateral connecting line 32 keeps the rescue lines gathered, preventing entanglement, simultaneously as the rescue lines 30*a*–30*h* can be pulled forwardly within the sea surface layer as some sort of "net".

Figure 2:
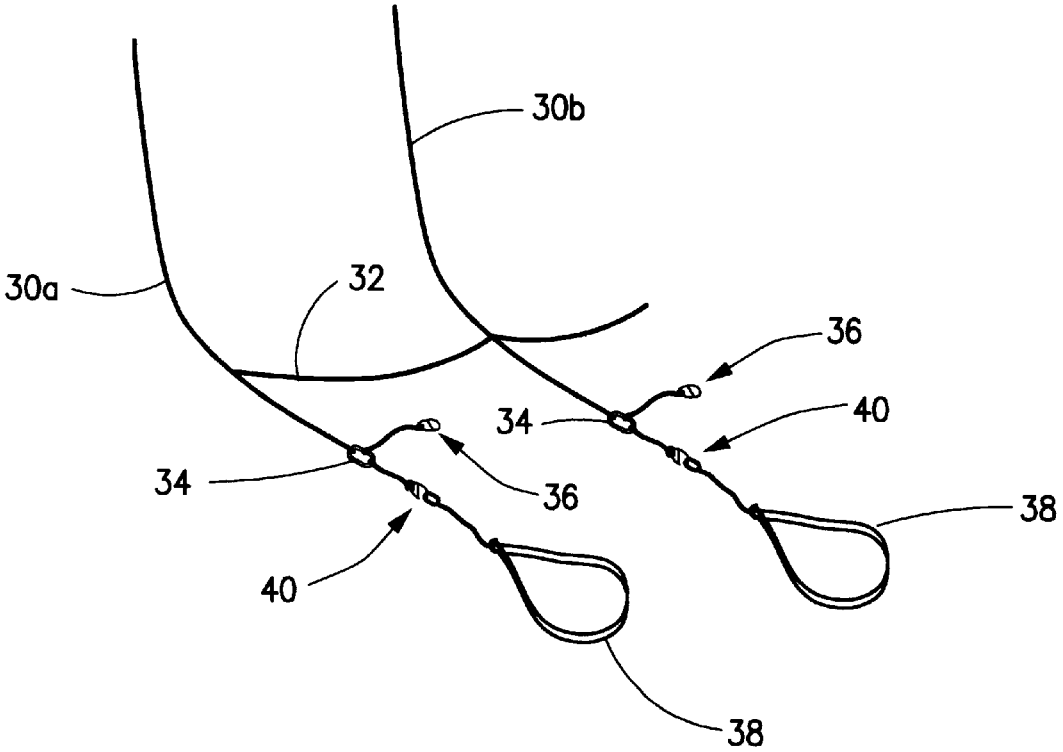
FIG. 2 is an enlarged perspective view of FIG. 1 and showing the lower portion of two adjacent rescue lines with equipment coupled thereto.
Figure 3:
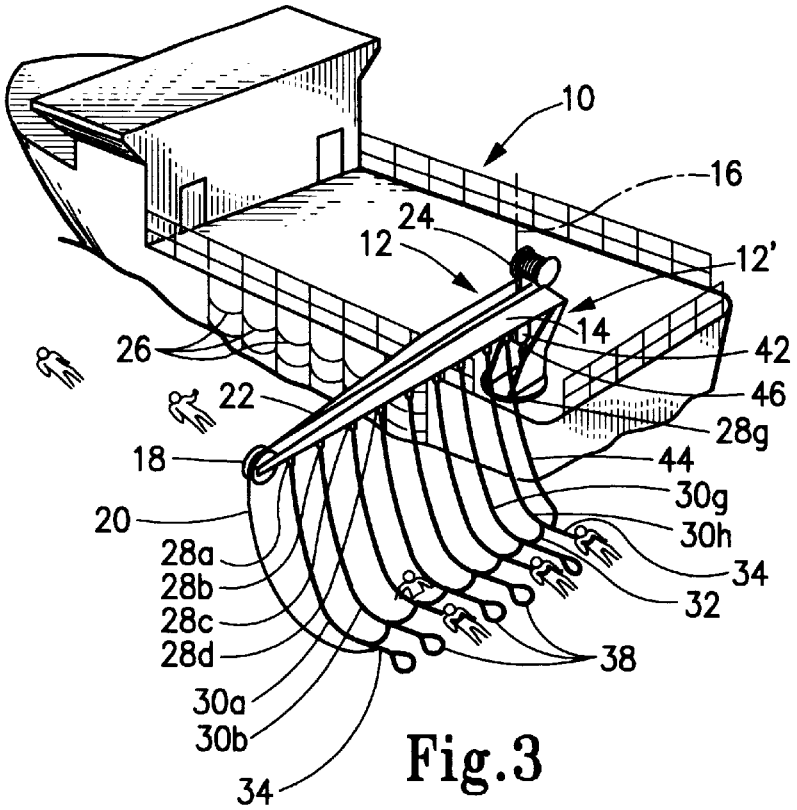
FIG. 3 shows a perspective view corresponding to FIG. 1, where two winches have been disposed on the crane beam, the winch lines thereof being connected to the man overboard device at the outer ends of the two outer rope-like rescue elements (the nearest and most remote in relation to the adjacent hull side)
Figure 4:
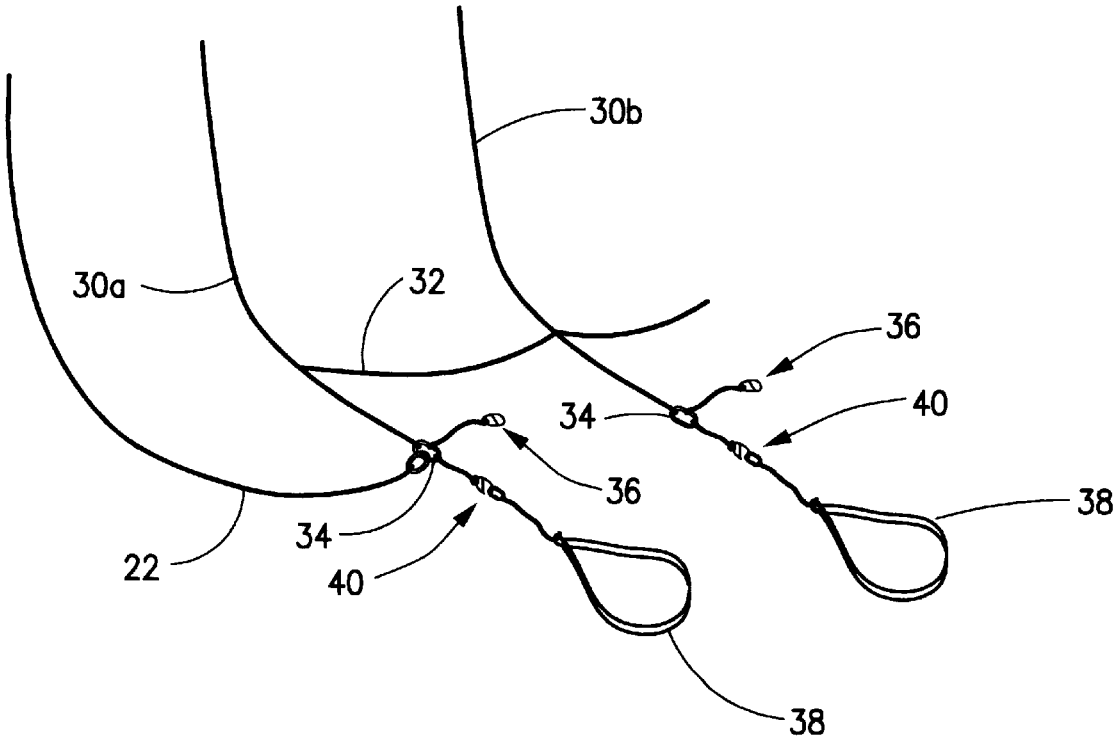
FIG. 4 shows a perspective view substantially corresponding to FIG. 2, but where the outer (lower) portion of one of said winch lines has been attached to a shackle or the like, carried by the rescue element belonging thereto.
Figure 5:
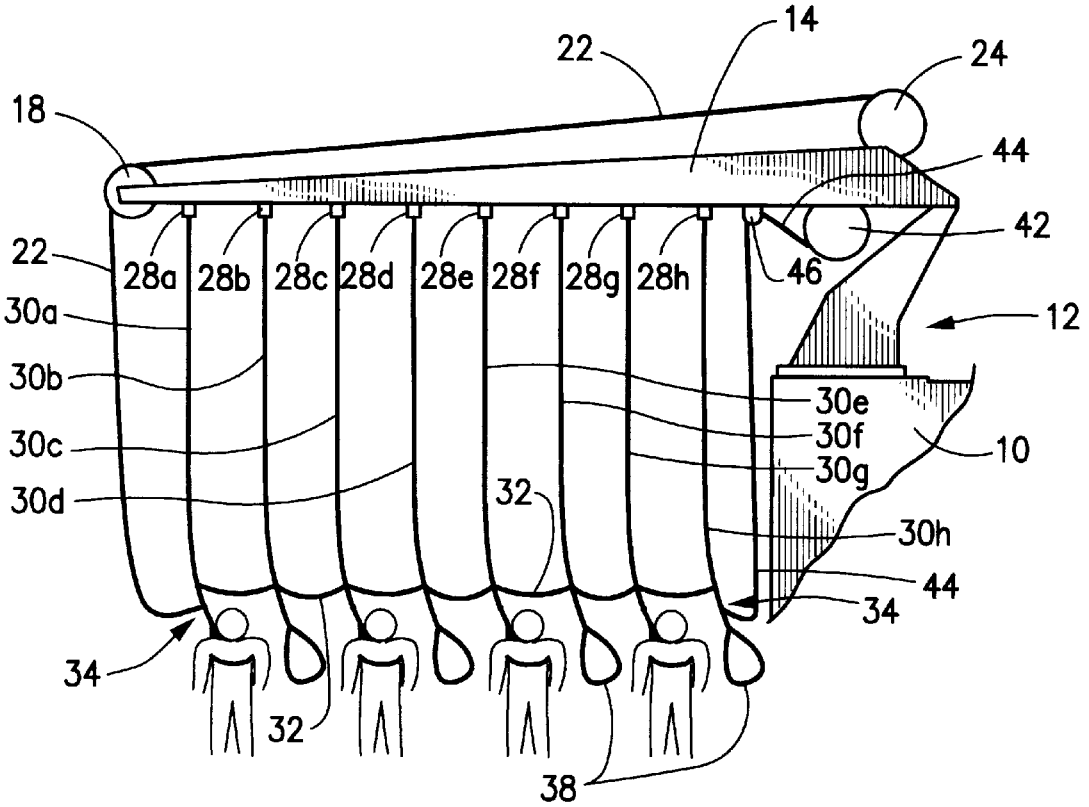
FIG. 5 is a rear view showing the crane beam swung out to take a position approximately at right angles to adjacent hull side portion, the man overboard device taking a downwardly suspended position.

As shown in FIG. 2, adjacent to the fee distal end of each rescue line 30*a*–30*h* is a shackle 34 for a snap hook 36 or some other hook which is the first means with which a man overboard usually comes into contact, and to which he should get anchored. Rescue suits, so called survival suits, will be provided with a hook fastener on the front.

At the free rescue line end, annular hoisting straps 38 or similar rescue equipment are fastened. The man overboard pulls this equipment closer to him, thereafter positioning it beneath his arms. The hoisting straps 38 are each anchored to the line end through a hook mechanism 40 comprising a ring and a hook engageable therein, so that the person in the hoisting straps 38 can be uncoupled from a rescue line and the crane beam for, possibly, being hoisted up into a helicopter.

Ten to fifteen such rescue lines 30*a*–30*h* or fasteners 28*a*–28*h* therefore may, as mentioned, be disposed along the crane beam 14 so that they cover a distance of approximately 20 meters. As shown in FIG. 1, innermost rescue line 30*h* or fastener 28*h*, respectively, is placed at a sufficient distance from the ship side so that, upon swing-out of crane beam 14, a man overboard drifting in the sea may grasp the inner rescue line without being subjected to the introductorily mentioned phenomenon of being pressed downwardly into the sea together with the ship side during the downwardly going movements thereof in heavy sea.

The lateral connecting line 32 may, possibly, be omitted. Alternatively, more than one lateral connecting line 32 may be placed between the same neighbor lines.

Reference is now made to the embodiment shown in FIGS. 3–6.

For the wire or winch line 22 of the winch 24 according to FIG. 1, the crane hook 20 has been omitted according to FIGS. 3–8. Here, the free end of the winch line 22 is shown attached to the outer rescue element 30*a* in the neighborhood of the outer (lower) end thereof. The physical attachment point for this first winch line 22 is not critical. One alternative attachment point might be a crossing point between the rescue element 30*a* and the lateral line 32.

On the underside of the crane beam 14, in the area of the first winch 24, a second winch 42 having a second winch line 44 has been disposed. Winch line 44 has its lower end coupled to a shackle 34 carried by a rescue element 30*h* situated nearest the hull side, below its connecting point with the lateral line 32.

Second winch line 44 is guided and controlled through an upper guide means 46, such as a caster, carried by the crane beam 14, so that it is allotted a downwardly suspended course substantially parallel with the adjacent rescue element 30*h* belonging thereto and having approximately the same longitudinal extent as that one; this arrangement gives rise to the least risk for entanglement.

Figure 6:
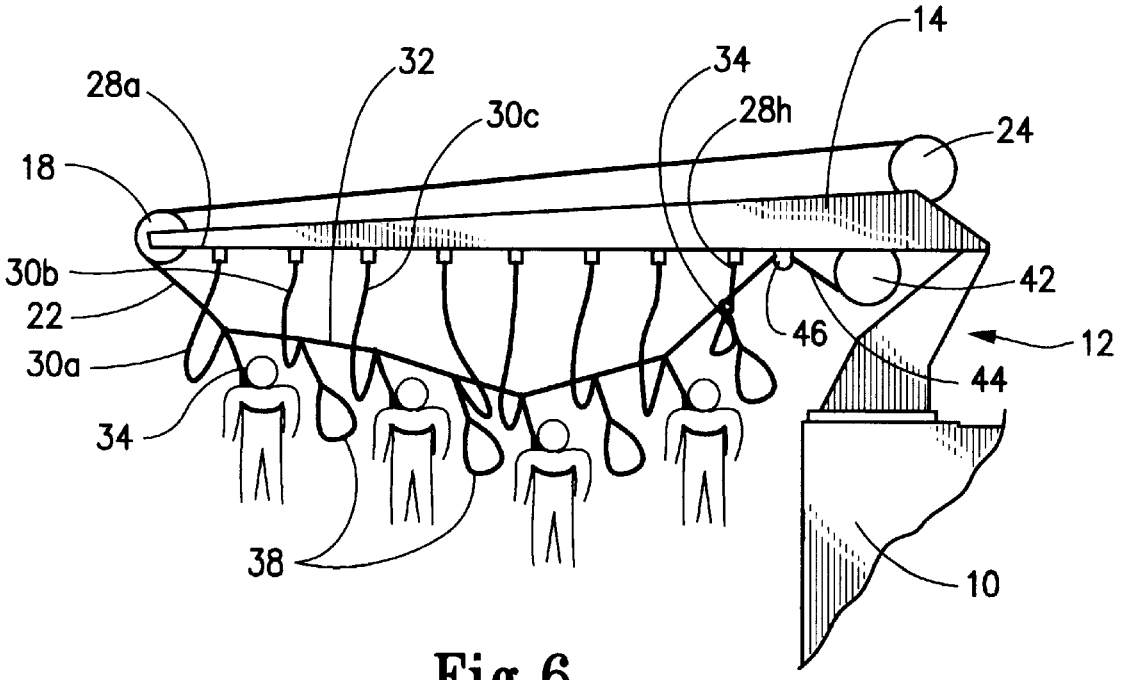
FIG. 6 corresponds to FIG. 5, but here the man overboard device has been hoisted by means of two winches.

As shown in FIG. 6, when first and second winches 24 and 42 are run simultaneously, the man overboard device, including elements 30*a* through 30*h*, winches 22 and 44 and men overboard located within the hoisting straps, is hoisted upwardly into an upper position. From here, the man overboard device through the crane beam 14 can be swung inwards above the boat deck.

From FIG. 6 it appears that an intermediate portion of the man overboard device will sag somewhat in the hoisted-up position, and in some cases, e.g. in heavy sea, this may present problems to a man overboard situated in an intermediate area of the man overboard device.

Figure 7:
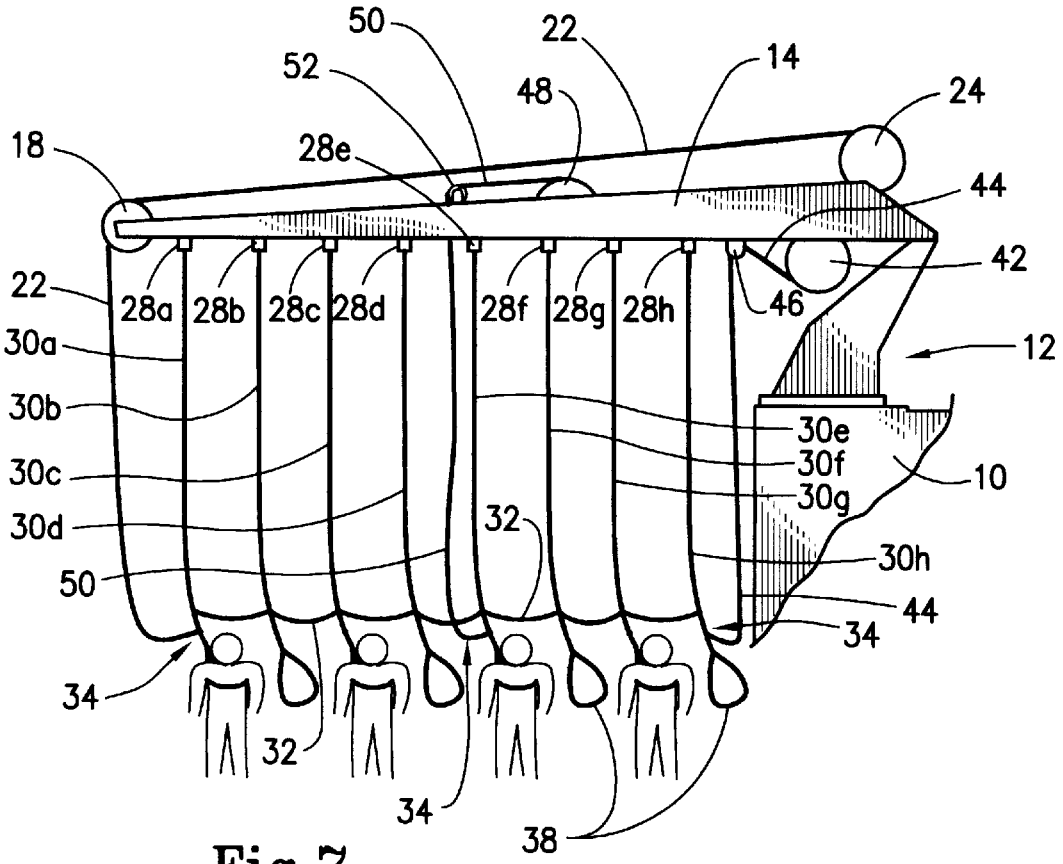
FIG. 7 corresponds to FIG. 5, but here a further (third) winch has, additionally, been disposed.
Figure 8:
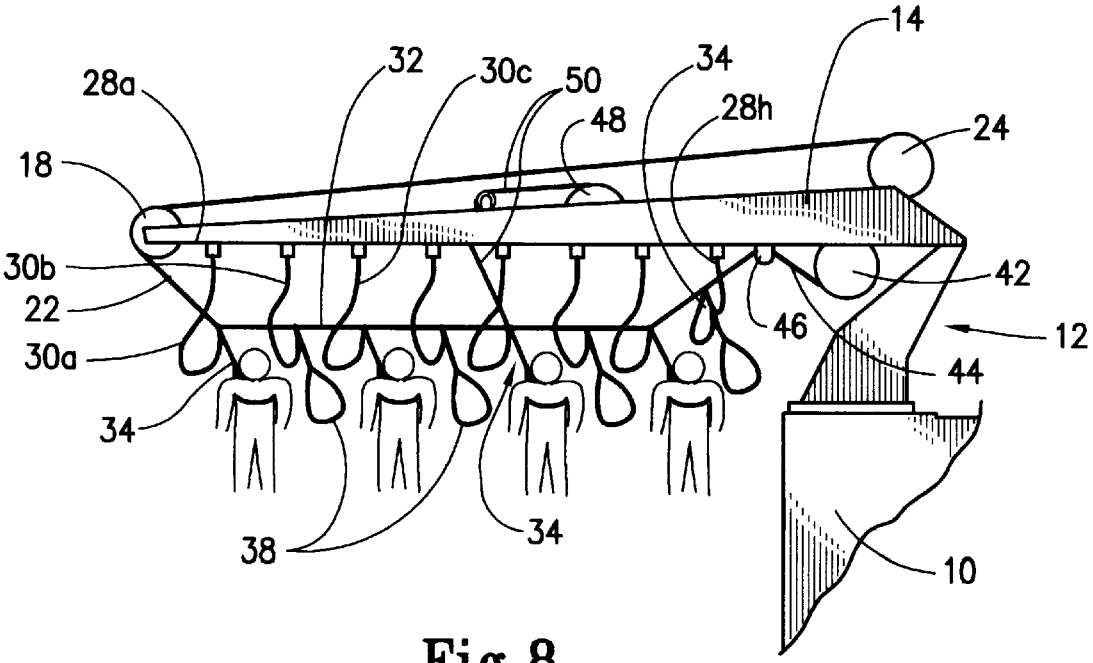
FIG. 8 shows an embodiment of the man overboard device according to FIG. 7, where the man overboard device has been hoisted up by means of three winches.

In order to avoid this disadvantage, a third winch 48 has been disposed in the embodiment according to FIGS. 7 and 8. This third winch 48 is likewise carried by the crane beam 14, approximately at the middle portion thereof, as well as being countersunk in relation to the upper face thereof, so that the upper portion of this third winch's 48 winch line 50 does not interfere with the overlying, first winch line 22. Third winch line 50 is assigned a guide means 52 in the form of a caster or the like.

The third winch line's 50 outer free end is attached to an intermediate rescue element, e.g. 30*e*, adjacent the lower end thereof, such as through a shackle 34.

As shown diagrammatically in FIG. 8, when a third winch 48 is run simultaneously with first winch 24 and second winch 42, and the approximately equally long winch lines 50, 22 and 44, respectively, are pulled substantially synchronously in, the man overboard device will be in a hoisted-up, contracted position substantially without a sagging intermediate portion. Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention with departing from the inventive concepts contained herein.

I claim:

1. A rescue device adapted for use with a ship to rescue individuals floating in the sea, comprising:

(a) a lifting crane adapted to be supported by said ship, said lifting crane including a crane beam having a proximal end mounted for pivotal movement about a vertical crane axis and extending laterally from said proximal end to terminate at a free end;

(b) a plurality of elongated and flexible rope-like elements suspended from said crane beam, each of said rope-like elements having a first end portion attached to said crane beam and extending from said first end portion to terminate at a free distal end; and (b) a plurality of connectors each operative to connect to the free distal end of an associated one of said rope-like elements, each of said connectors sized and adapted to securely engage an individual in need of rescue so that the individual can be lifted out of the sea by said lifting crane.

2. A rescue device according to claim 1 including a laterally extending connecting line joined to at least some of said rope-like elements proximate to the free distal ends thereof.

3. A rescue device according to claim 2 wherein each of said rope-like elements includes a shackle disposed proximately to the free distal end thereof, and including a fastener interconnected to said shackle.

4. A rescue device according to claim 3 wherein each of said connectors is formed as a hoisting strap.

5. A rescue device according to claim 4 including a coupler associated with each of said rope-like elements and selectively operative to disconnect said rope-like element from its associated said hoisting strap.

6. A rescue device according to claim 3 including a plurality of winch lines each extending from a respective winch associated with said crane beam, a first one of said winch lines extending from a first winch that is mounted to a proximal end portion of said crane beam and having a free end thereof connected to the shackle associated with an outermost one of said rope-like rescue elements, and a second one of said winch lines extending from a second winch that is mounted to a free end portion of said crane beam and having a free end thereof connected to the shackle associated with an innermost one of said rope-like rescue elements.

7. A rescue device according to claim 6 wherein each of said first and second winch lines extends alongside its associated one of said rope-like rescue elements.

8. A rescue device according to claim 7 including a third winch line connected to and extending alongside an associated third one of said rope-like rescue elements, said third winch line positioned intermediately of said first and second winch lines.

9. A rescue device according to claim 6 including a third winch line connected to and extending alongside an associated third one of said rope-like rescue elements, said third winch line positioned intermediately of said first and second winch lines.

10. A rescue device according to claim 1 wherein each of said rope-like elements includes a shackle disposed proximately to the free distal end thereof, and including a fastener interconnected to said shackle.

11. A rescue device according to claim 10 including a plurality of winch lines each extending from a respective winch associated with said crane beam, a first one of said winch lines extending from a first winch that is mounted to a proximal end portion of said crane beam and having a free end thereof connected to the shackle associated with an outermost one of said rope-like rescue elements, and a second one of said winch lines extending from a second winch that is mounted to a free end portion of said crane beam and having a free end thereof connected to the shackle associated with an innermost one of said rope-like rescue elements.

12. A rescue device according to claim 11 including a third winch line connected to and extending alongside an associated third one of said rope-like rescue elements, said third winch line positioned intermediately of said first and second winch lines.

13. A rescue device according to claim 11 wherein each of said first and second winch lines extends alongside its associated one of said rope-like rescue elements.

14. A rescue device according to claim 13 including a third winch line connected to and extending alongside an associated third one of said rope-like rescue elements, said third winch line positioned intermediately of said first and second winch lines.

15. A rescue device according to claim 10 wherein each of said connectors is formed as a hoisting strap.

16. A rescue device according to claim 15 including a coupler associated with each of said rope-like elements and selectively operative to disconnect said rope-like element from its associated said hoisting strap.

17. A rescue device adapted for use with a ship to rescue individuals floating in the sea, comprising:

(a) a lifting crane adapted to be supported by said ship, said lifting crane including a crane beam having a proximal end mounted for pivotal movement about a vertical crane axis and extending laterally from said proximal end to terminate at a free end;

(b) a plurality of fasteners attached to said crane beam and equidistantly distributed therealong;

(c) a plurality of elongated and flexible rope-like elements each having a first end portion adapted for attachment to a respective one of said fasteners and extending from said first end portion to terminate at a free distal end; and (d) a plurality of connectors each operative to connect to the free distal end of an associated one of said rope-like elements, each of said connectors sized and adapted to securely engage an individual in need of rescue so that the individual can be lifted out of the sea by said lifting crane.

18. A rescue device according to claim 17 including a laterally extending connecting line joined to at least some of said rope-like elements proximate to the fee distal ends thereof.

19. A rescue device according to claim 17 wherein each of said rope-like elements includes a shackle disposed proximately to the free distal end thereof, and including a fastener interconnected to said shackle.

20. A rescue device according to claim 17 wherein each of said connectors is formed as a hoisting strap and including a coupler associated with each of said rope-like elements and selectively operative to disconnect said rope-like element from its associated said hoisting strap.

21. A rescue device according to claim 19 including a plurality of winch lines each extending from a respective winch associated with said crane beam, a first one of said winch lines extending alongside an associated first one of said rope-like elements from a first winch that is mounted to a proximal end portion of said crane beam and having a free end thereof connected to the shackle associated with an outermost one of said rope-like rescue elements, and a second one of said winch lines extending alongside an associated second one of said rope-like elements from a second winch that is mounted to a free end portion of said crane beam and having a free end thereof connected to the shackle associated with an innermost one of said rope-like rescue elements.

22. A rescue device according to claim 21 including a third winch line connected to and extending alongside an associated third one of said rope-like rescue elements, said third winch line positioned intermediately of said first and second winch lines.

23. In a ship having a lifting crane supported on a deck thereof, wherein said lifting crane includes a crane beam mounted for pivotal movement about a vertical crane axis, the improvement comprising a man overboard device including a plurality of fasteners attached to said crane beam and equidistantly distributed therealong, each of said fasteners adapted to serve as a fastening means for one of a corresponding number of elongated and flexible rope-like elements, each of said rope-like elements having a proximal end portion attached to an associated one of said fasteners and extending from said proximal end portion to terminate at a distal end, and including a plurality of connectors each operative to connect to the free distal end of an associated one of said rope-like elements, each of said connectors sized and adapted to securely engage an individual in need of rescue so that the individual can be lifted out of the sea by said lifting crane.

24. The improvement according to claim 23 including a laterally extending connecting line joined to at least some of said rope-like elements proximate to the free distal ends thereof.

25. The improvement according to claim 24 wherein each of said rope-like elements includes a shackle disposed proximately to the free distal end thereof, and including a fastener interconnected to said shackle.

26. The improvement according to claim 25 wherein each of said connectors is formed as a hoisting strap and including a coupler associated with each of said rope-like elements and selectively operative to disconnect said rope-like element from its associated said hoisting strap.

27. In a ship having a lifting crane supported on a deck thereof, wherein said lifting crane includes a crane beam mounted for pivotable movement about a vertical axis, the improvement comprising a man overboard device including a plurality of elongated and flexible rope-like elements suspended from said crane beam, each of said rope-like elements having a proximal end portion attached to said crane beam and extending from said proximal end portion to terminate at a free distal end, and including a plurality of connectors each operative to connect to the free distal end of an associated one of said rope-like elements, each of said connectors sized and adapted to securely engage an individual in need of rescue so that the individual can be lifted out of the sea by said lifting crane.

28. The improvement according to claim 27 including a laterally extending connecting line joined to at least some of said rope-like elements proximate to the free distal ends thereof.

29. The improvement according to claim 28 wherein each of said rope-like elements includes a shackle disposed proximately to the free distal end thereof, and including a fastener interconnected to said shackle.

30. The improvement according to claim 29 wherein each of said connectors is formed as a hoisting strap and including a coupler associated with each of said rope-like elements and selectively operative to disconnect said rope-like element from its associated said hoisting strap.

* * * * *